US008330678B2

(12) United States Patent
Kohno et al.

(10) Patent No.: US 8,330,678 B2
(45) Date of Patent: Dec. 11, 2012

(54) METHOD OF CORRECTING NONUNIFORMITY OF PIXELS IN AN OLED

(75) Inventors: Makoto Kohno, Kanagawa (JP); Kouichi Onomura, Yokohama (JP); Seiichi Mizukoshi, Kanagawa (JP)

(73) Assignee: Global OLED Technology LLC, Herndon, VA (US)

( * ) Notice: Subject to any disclaimer, the term of this patent is extended or adjusted under 35 U.S.C. 154(b) by 801 days.

(21) Appl. No.: 11/424,245

(22) Filed: Jun. 15, 2006

(65) Prior Publication Data

US 2007/0008251 A1 Jan. 11, 2007

(30) Foreign Application Priority Data

Jul. 7, 2005 (JP) ..... 2005-199285

(51) Int. Cl.
*G09G 3/30* (2006.01)

(52) U.S. Cl. ..... 345/76; 345/77; 345/82; 345/204; 345/690; 315/169.3

(58) Field of Classification Search ..... 345/76, 345/55, 36, 77, 82, 83, 207, 690, 88, 89, 345/90, 204; 315/169.3
See application file for complete search history.

(56) References Cited

U.S. PATENT DOCUMENTS

| | | | | |
|---|---|---|---|---|
| 4,945,502 | A * | 7/1990 | Kwon et al. | 382/275 |
| 6,456,339 | B1 * | 9/2002 | Surati et al. | 348/745 |
| 6,501,230 | B1 * | 12/2002 | Feldman | 315/169.3 |
| 2004/0150592 | A1 * | 8/2004 | Mizukoshi et al. | 345/76 |
| 2006/0262147 | A1 * | 11/2006 | Kimpe et al. | 345/690 |

FOREIGN PATENT DOCUMENTS

| | | |
|---|---|---|
| JP | 11-282420 | 10/1999 |
| JP | 2004-264793 | 9/2004 |

* cited by examiner

*Primary Examiner* — Lun-Yi Lao
*Assistant Examiner* — Olga Merkoulova
(74) *Attorney, Agent, or Firm* — Morgan, Lewis & Bockius LLP

(57) ABSTRACT

Nonuniformity in an organic EL display device is effectively detected. All display pixels of an organic EL panel are turned on and the display is photographed with a digital camera. A computer performs image processing of the photographed image to detect an area in which unevenness exists. Then, a V-I curve of each pixel in the area is measured to calculate necessary correction values. The calculated correction values are stored in a memory for use in correcting a signal input to the organic EL panel.

1 Claim, 16 Drawing Sheets

EXAMPLE OF IMAGE INCLUDING MOIRE AND LUMINANCE VARIATION

METHOD OF CORRECTING NONUNIFORMITY OF PIXELS IN AN OLED

FIELD OF THE INVENTION

The present invention relates to correction of a nonuniformity of display in an organic electroluminescence (EL) display device formed by arranging organic EL elements in a matrix.

BACKGROUND OF THE INVENTION

Organic EL (OLED) display devices formed by arranging organic EL (OLED) elements in a matrix are conventionally well known. Among such displays, it is widely expected that a major stream of development of thin-shaped display devices will involve active type OLED display devices, in which the drive current for each OLED element is controlled by a transistor formed for each pixel.

FIG. 1 shows an example of a pixel circuit of a conventional active type OLED display device. The source of a pixel driving P channel TFT 1 is connected to a power source PVdd, and the drain of the TFT 1 is connected to the anode of an organic EL (OLED) element 3, while the cathode of the OLED element 3 is connected to a negative power source CV.

The gate of the TFT 1 is connected to the power source PVdd through an auxiliary capacity C, and further is connected to a data line Data, to which a voltage based on pixel data (luminance data) is supplied, through an n channel TFT 2 for selection. Then, the gate of the TFT 2 is connected to a gate line Gate extending horizontally.

During display, the gate line Gate is raised to an H level, and the corresponding TFT's 2 are turned on. In this state, pixel data (or an input voltage based on the pixel data) is supplied to the data line Data, and the pixel data is charged in the auxiliary capacity C. Then, the TFT 1 is driven by a voltage according to the pixel data, and a current flows to the OLED element 3.

Here, although the amount of light emission of the OLED element 3 and the amount of current are almost strictly proportional, the TFT 1 only permits a current to flow when a potential difference Vgs between the gate of the TFT 1 and the power source PVdd exceeds a predetermined threshold voltage Vth. Accordingly, a voltage (threshold voltage Vth) is added to the pixel data supplied to the data line Data so that the drain current may begin to flow near a black level of an image. Moreover, the amplitude of an image signal by which the luminance of a displayed image becomes predetermined luminance near a white level is given as the amplitude of an image signal.

FIG. 2 shows an example of the relations (V-I characteristic) of input voltages (Vgs), and the luminance of the OLED element 3 and currents icv flowing through the OLED element 3. As shown in FIG. 2, the OLED element 3 is set to begin to emit light when the input voltage Vgs is the threshold voltage Vth, and to emit light of a predetermined luminance when the input voltage corresponds to the white level.

As noted, an OLED display device is composed of a display panel on which many pixels are arranged in a matrix. Consequently, the threshold voltage Vth and the inclination of the V-I characteristic may vary among pixels due to manufacturing defects or tolerances, and the light emission amount relative to a data signal (input voltage) may become uneven among the pixels. Consequently, uneven luminance may be generated. FIGS. 3A and 3B are explanatory diagrams when the threshold voltages Vth or the inclinations of the V-I characteristics of two pixels m and n are dispersed, respectively, and FIG. 3C is an explanatory diagram when the both of them are dispersed. As shown in the drawings, when the threshold voltages Vth are dispersed by a voltage ΔVth in the two pixels, the curves of the V-I characteristics become ones shifted by the voltage ΔVth from each other. Moreover, when the inclinations of the V-I characteristics are dispersed in the two pixels, the inclinations of the curves of the V-I characteristics differ from each other. Incidentally, the dispersion of the threshold voltages Vth and the dispersion of the inclinations of the V-I characteristics may be generated in just part of a display screen.

Accordingly, a method of measuring the luminance of each pixel to correct all of the pixels or only defective pixels in accordance with correction data stored in a memory has been proposed in, for example, Japanese Patent Laid-Open Publication No. Hei 11-282420.

Moreover, a method of dividing a display area of a display panel including many pixels into small areas, measuring a current in each area, calculating the overall tendency, and calculating a coefficient for correcting the entire display, or for performing a correction of each area has also been proposed in, for example, Japanese Patent Laid-Open Publication No. 2004-264793.

However, with the method disclosed in Japanese Patent Laid-Open Publication No. Hei 11-282420, it is generally difficult to accurately measure the luminance of pixels of a panel including many pixels with a reasonably short time, while, with the method disclosed in Japanese Patent Laid-Open Publication No. 2004-264793, only the dispersion of luminance changing continuously over the entire display area, or the luminance unevenness in specific patterns such as vertical lines or horizontal lines, can be corrected.

SUMMARY OF THE INVENTION

The present invention advantageously provides an organic EL display device with which nonuniformity can be effectively detected, and correction values calculated to perform correction.

According to the present invention, there is provided a method of manufacturing an organic EL display device formed by arranging display pixels, each including an organic EL element, in a matrix, the method including photographing an image in a display area with an imaging apparatus to specify an area in which display unevenness exists; causing the organic EL elements of the display pixels in the specified area to emit light selectively to detect a drive current of the light emission; detecting positions of pixels necessary for being corrected and correction data of the correction based on the detected drive current; and storing the obtained positions of the pixels necessary for being corrected and the obtained correction data in a memory.

Moreover, it is preferable that the area in which the display unevenness exists be detected by comparing each data in a block with an average value of all the data in the block, the block being one of blocks produced by dividing the image of the display area into blocks of a predetermined size.

Moreover, it is preferable that image data is compared after being transformed into frequency regions in every block, removing specific frequency components, and receiving inverse transformation.

Moreover, it is preferable that each block overlaps with another block.

According to the present invention, an area in which display unevenness exists is specified based on the photographed image, and the currents in the specified area and the currents of the peripheral pixels are measured to obtain accurate correction data. When there are many pixels, a relatively very long time is required to measure the currents of all of the pixels on a display panel, but, because the area to be measured can be specified by the present invention, it becomes possible to shorten the time considerably. Moreover, in an analysis using a photographed image, no quantitative measurements of luminance unevenness are necessary, and it is sufficient to know the rough position and the rough size of an area where unevenness exists, and no expensive and precise photography equipment is needed. Thus, when the size of an area in which luminance unevenness exists is comparatively small, or when luminance unevenness by a pixel or by a dot is corrected, correction data can be obtained effectively.

DETAILED DESCRIPTION OF THE PREFERRED EMBODIMENT

The preferred embodiment of the present invention is described below with reference to the attached drawings.

Figure 1:
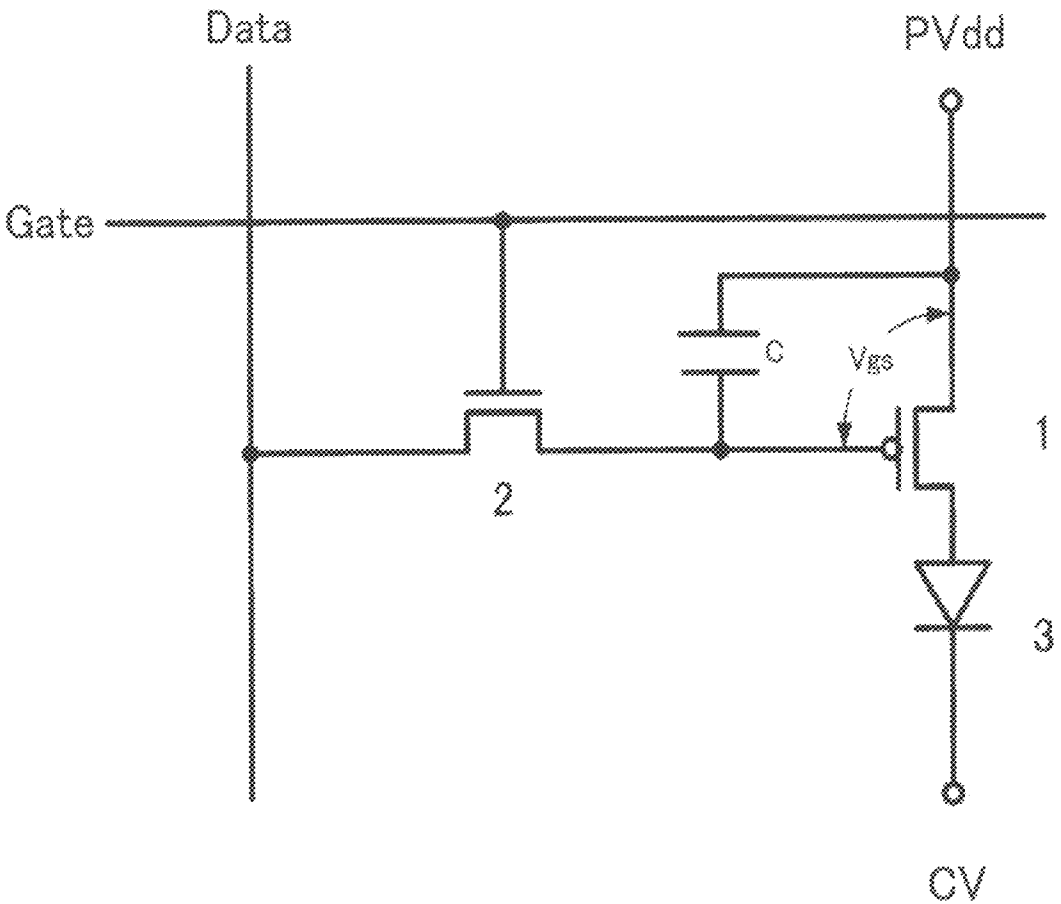
Fig. 1 (PRIOR ART)
FIG. 1 is a diagram showing the configuration of a conventional pixel circuit.
Figure 2:
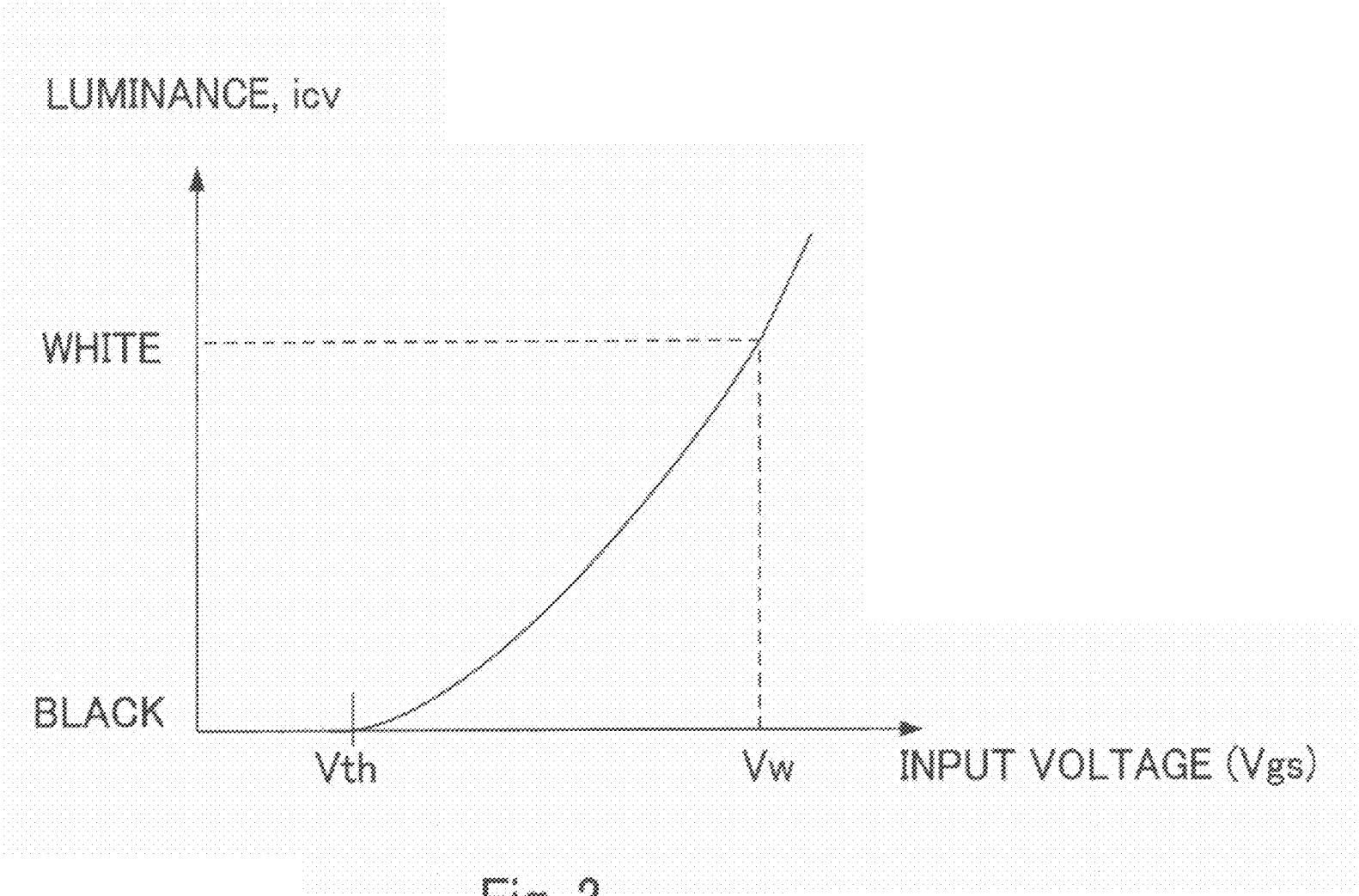
Fig. 2 (PRIOR ART)
FIG. 2 is a diagram showing relations between input voltages and luminance (drive currents)
Figure 3A:
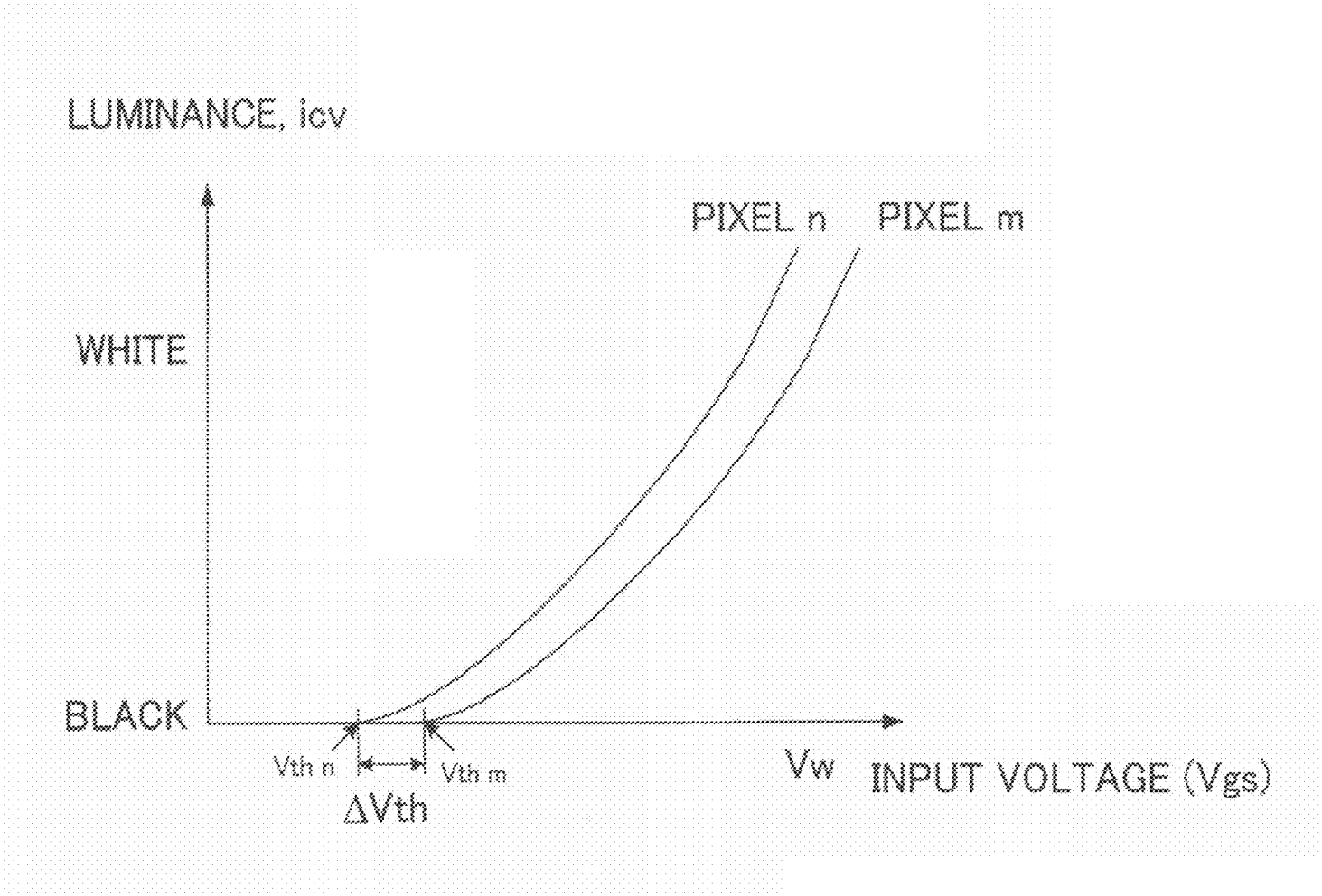
Fig. 3A (PRIOR ART)
FIG. 3A is a diagram showing dispersion of threshold voltages of TFT's.
Figure 3B:
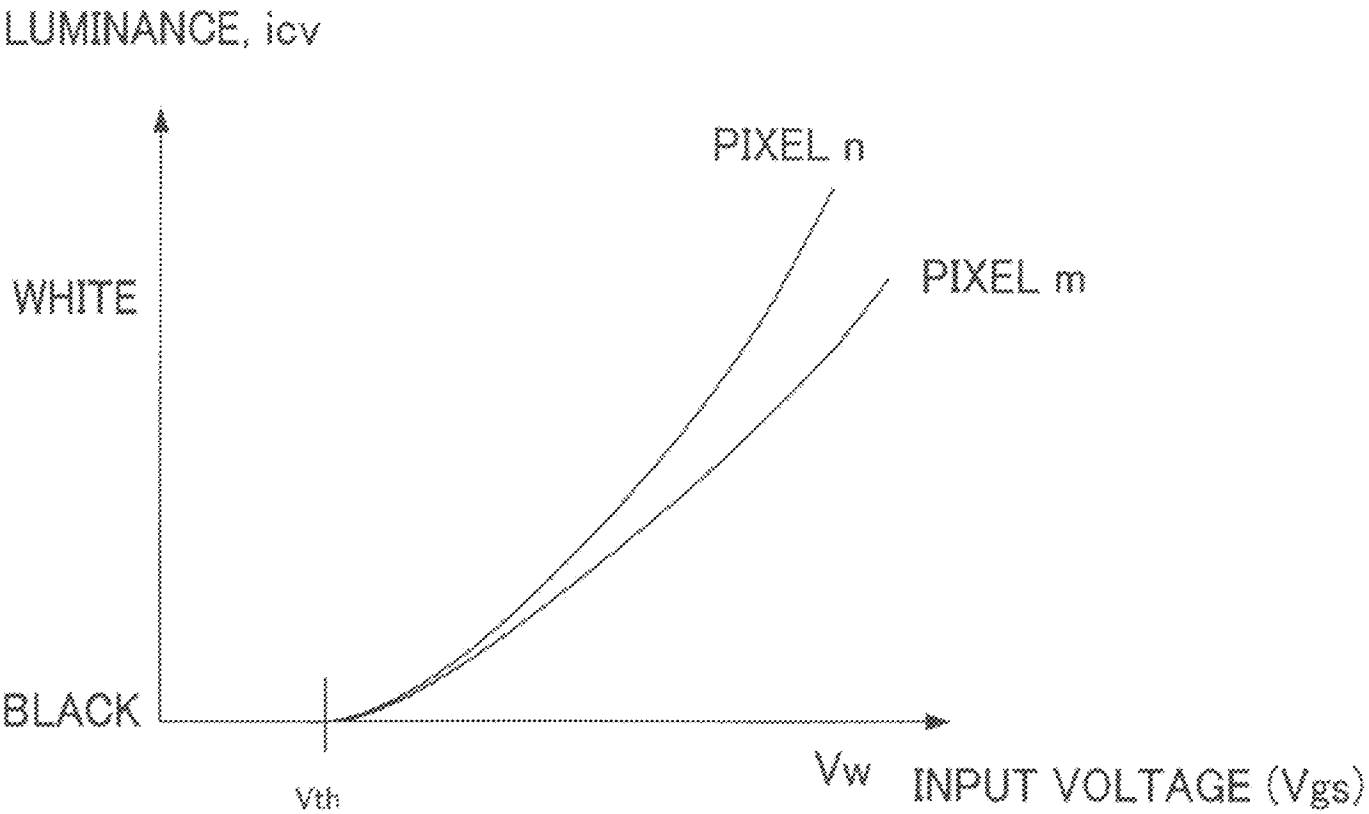
Fig. 3B (PRIOR ART)
FIG. 3B is a diagram showing dispersion of V-I characteristics of TFT's.
Figure 3C:
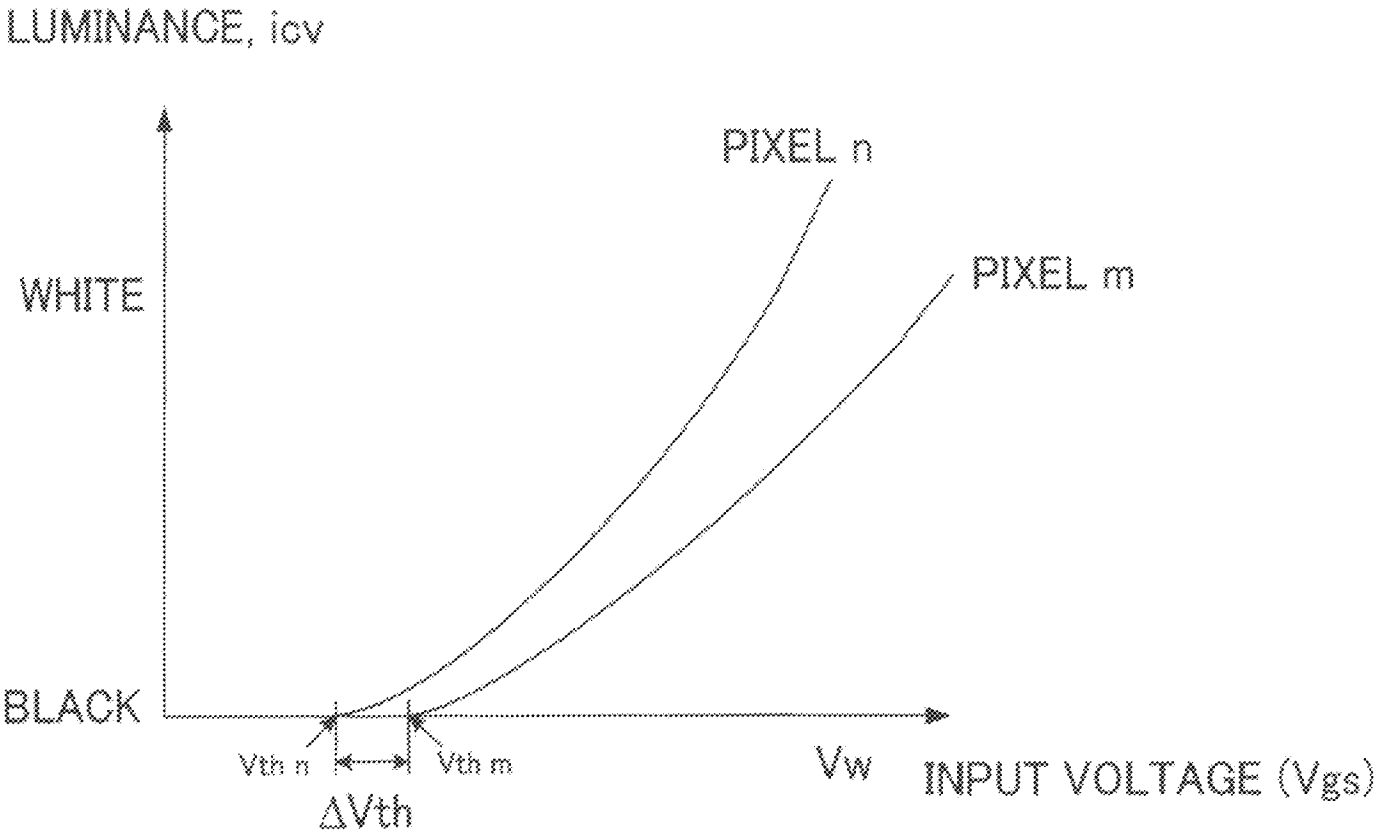
Fig. 3C (PRIOR ART)
FIG. 3C is a diagram showing dispersion of threshold voltages and inclinations of V-I characteristics of TFT's.
Figure 4:
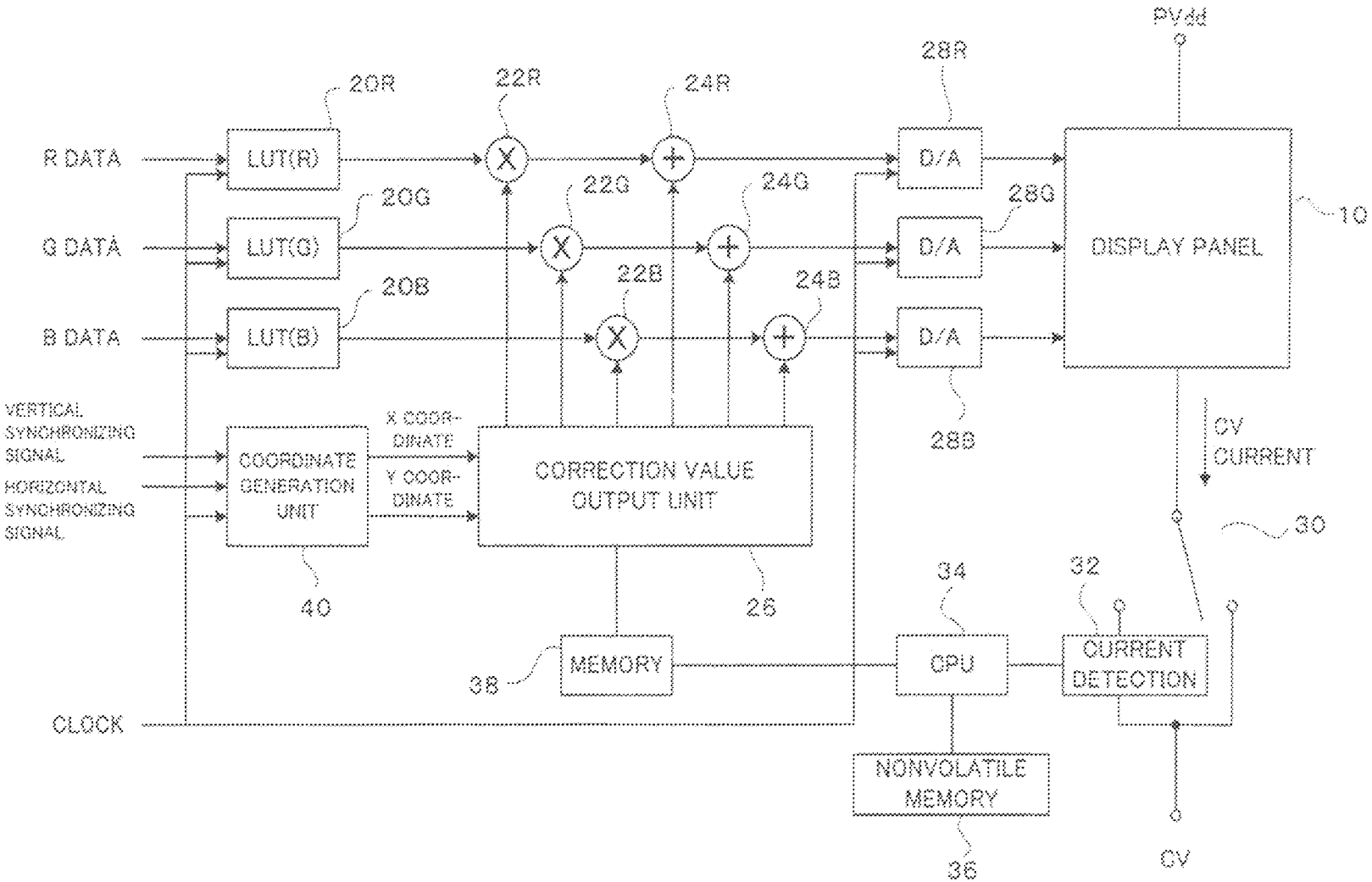
FIG. 4 is a diagram showing the configuration of a display device.

FIG. 4 shows the configuration of an organic EL display device correcting luminance data based on pre-stored correction data in order to supply the corrected luminance data to a display panel.

The display panel 10 includes pixels of each color of R, G and B, and input data (pixel data, or luminance data), which is a voltage signal relative to the luminance of each pixel, is independently input for each color of R, G and B. For example, when pixels of the same color are arranged in the vertical direction, data signals of any one of the R, G and B are supplied to each data line, and consequently display of all colors can be performed. It should be noted that, in this example, it is supposed that each set of data of R, G and B is luminance data of eight bits, and that the resolution of the display panel is 320 pixels in the horizontal direction and 240 lines in the vertical direction, and further that each pixel is composed of dots of three colors of R, G and B.

In the following, the coordinate of a dot in a display area is notated by (x, y) and an example is described in which the coordinate x in the horizontal direction becomes larger progressing rightward and the coordinate y in the vertical direction becomes larger progressing downward. Consequently, the coordinate of the dot of a display area at the top left corner is notated by (1, 1), and the coordinate of the dot at the bottom right corner is notated by (960, 240).

An R signal, a G signal, and a B signal are supplied to look-up tables (LUT's) 20R, 20G and 20B, respectively. The look-up tables 20R, 20G and 20B severally store table data for performing a gamma correction so that the relations of the luminance of emitted light (or the drive currents) to the input data (or the luminance data) may be a desired curve in consideration of an average offset and an average gain in the display panel 10. Consequently, by transforming the luminance data using the look-up tables 20R, 20G and 20B, the light emission amount of an organic EL element becomes an amount corresponding to the luminance data when a drive TFT having an average characteristic is driven. It should be noted here that characteristic formulae may be stored to perform the transformation to the luminance data by operations in place of the look-up tables 20R, 20G and 20B.

Additionally, clocks synchronizing with pixel data may be supplied to the look-up tables 20R, 20G and 20B, and the outputs from the look-up tables 20R, 20G and 20B may be synchronized with the clocks.

The outputs of the look-up tables 20R, 20G and 20B are supplied to multipliers 22R, 22G and 22B, respectively. Correction values for correcting the dispersion of the inclinations of the V-I characteristics at every pixel are severally supplied from a correction value output unit 26 to the multipliers 22R, 22G and 22B.

The outputs of the multipliers 22R, 22G and 22B are supplied to adders 24R, 24G and 24B, respectively. Correction values for correcting the dispersion of the threshold voltages Vth at every pixel from the correction value output unit 26 are severally supplied to the adders 24R, 24G and 24B.

Then, the outputs of the adders 24R, 24G and 24B are supplied to D/A converters 28R, 28G and 28B, and are there converted to analog data signals, which are in turn supplied to the input terminal of each color of the display panel 10. Then, the data signals corrected by every color by every pixel are supplied to the data lines Data, and EL elements are driven by currents according to the data signals at each pixel.

Here, the positive side of the display panel 10 is connected to the power source PVdd, and the negative side thereof is connected to a low voltage power source CV through a switch 30 directly, or through the switch 30 and a current detector 32. Meanwhile, the negative side of the display panel 10 is connected with the constant voltage power source CV directly at the time of the normal use through the switch 30, and, the current detector 32 is selected with the switch 30, for example, at the time of correction data calculation at the factory.

When the current detector 32 is selected with the switch 30, the detection value of the current detector 32 is supplied to a CPU 34 as digital data. A nonvolatile memory 36 such as a flash memory or an EEPROM is connected to the CPU 34, and the positions of display pixels (or dots) for which correction is necessary and correction data corresponding to the pixels are stored in the nonvolatile memory 36.

It should be noted that, although in this example the correction data is the offset values and the gain values for performing the transformation of the input voltages corresponding to luminance data into input data to be actually supplied to the panel, the correction data may be data for correcting general offset values and general gain values.

A memory 38 is connected to the CPU 34, and the CPU 34 transfers the data stored in the nonvolatile memory 36 to the memory 38. The memory 38 is composed of, for example, a RAM.

In this example, the CPU 34 is a microcomputer controlling various operations of the OLED display device, and writes the above-mentioned correction data stored in the nonvolatile memory 36 into the memory 38 at the time of a rise of the power source of the OLED display device.

The memory 38 is connected to the correction value output unit 26, and the memory 38 supplies the data which the correction value output unit 26 supplies to the multipliers 22R, 22G and 22B and the adders 24R, 24G and 24B to the correction value output unit 26.

A coordinate generation unit 40 is also connected to the correction value output unit 26. A vertical synchronizing signal, a horizontal synchronizing signal and clocks synchronizing with pixel data are input into the coordinate generation unit 40, and the coordinate generation unit 40 generates coordinate signals synchronizing with input data (or pixel data). Then, the generated coordinate signals are supplied to the correction value output unit 26.

When the pixel position of the input data supplied from the coordinate generation unit 40 matches the pixel position at which correction is necessary, the correction value output unit 26 reads the correction data (concerning both of the inclination of the V-I characteristic and the shift of the threshold voltage Vth) corresponding to the pixel stored in the memory 38, and the correction value output unit 26 supplies the read correction data to the multipliers 22R, 22G and 22B and the adders 24R, 24G and 24B. Consequently, corrections based on the correction data are performed in the multipliers 22R, 22G and 22B and the adders 24R, 24G and 24B, and the pixel data of corrected R, G and B is supplied to the D/A converters 28R, 28G and 28B.

Thus, the luminance nonuniformity generated in the OLED display elements owing to the problems on manufacture can be corrected.

Detection of Unevenness i) Detection of Area Including Unevenness

Figure 5:
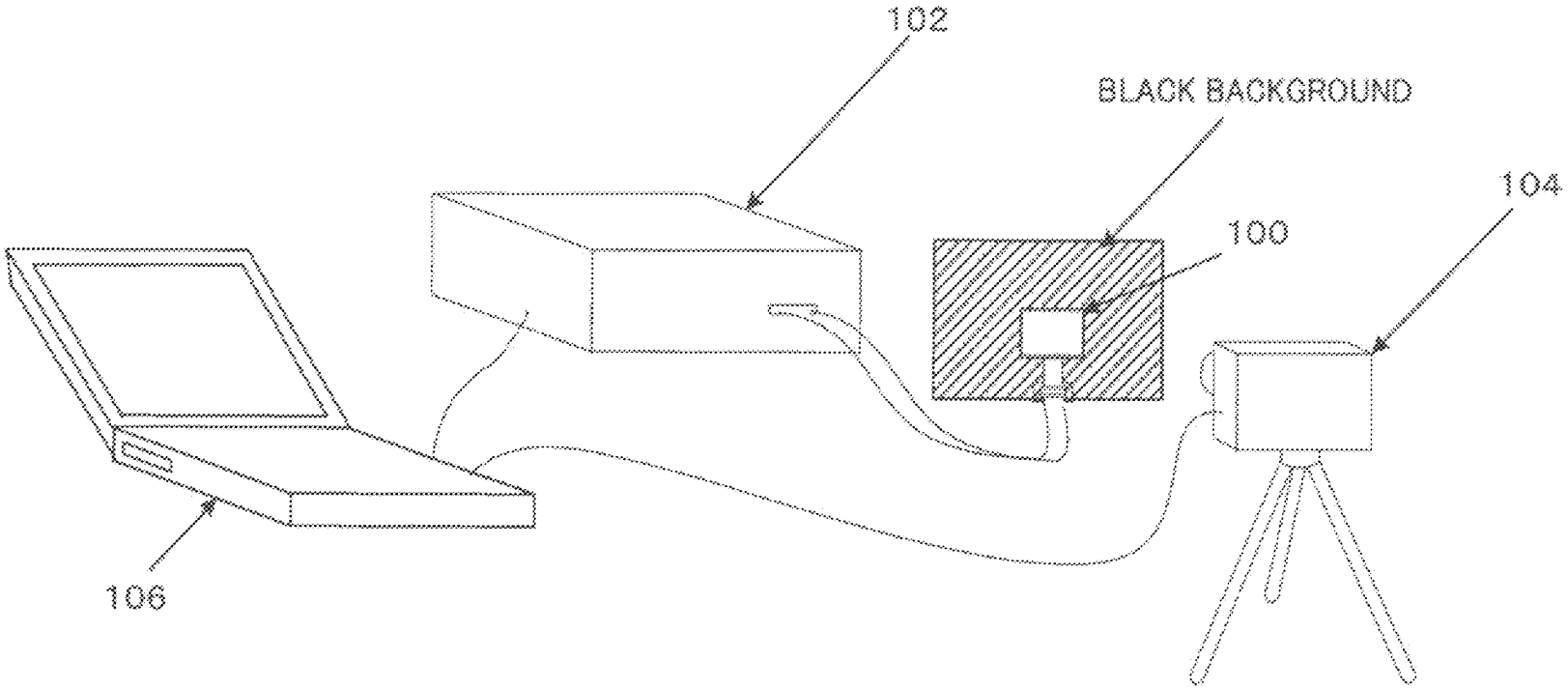
FIG. 5 is a view showing the configuration for photographing an organic EL panel.

In FIG. 5, an organic EL panel 100 is arranged in a darkroom, and the background of the organic EL panel 100 is made to be black. A panel drive apparatus 102 generating a white signal to display a flat image on the entire surface of the display is connected to the organic EL panel 100, and an image signal is supplied from the panel drive apparatus 102 to the organic EL panel 100. Then, an image of the organic EL panel 100 of the black background in the state in which all display pixels are tuned on (white display) is photographed with a digital camera 104. In this example, a digital camera of 2000×1500 pixels is used.

Next, the obtained photographed image data is supplied to a computer 106, which also controls the operation of the panel drive apparatus 102. The computer 106 performs the following processing on the image data supplied from the digital camera 104.

Figure 6:
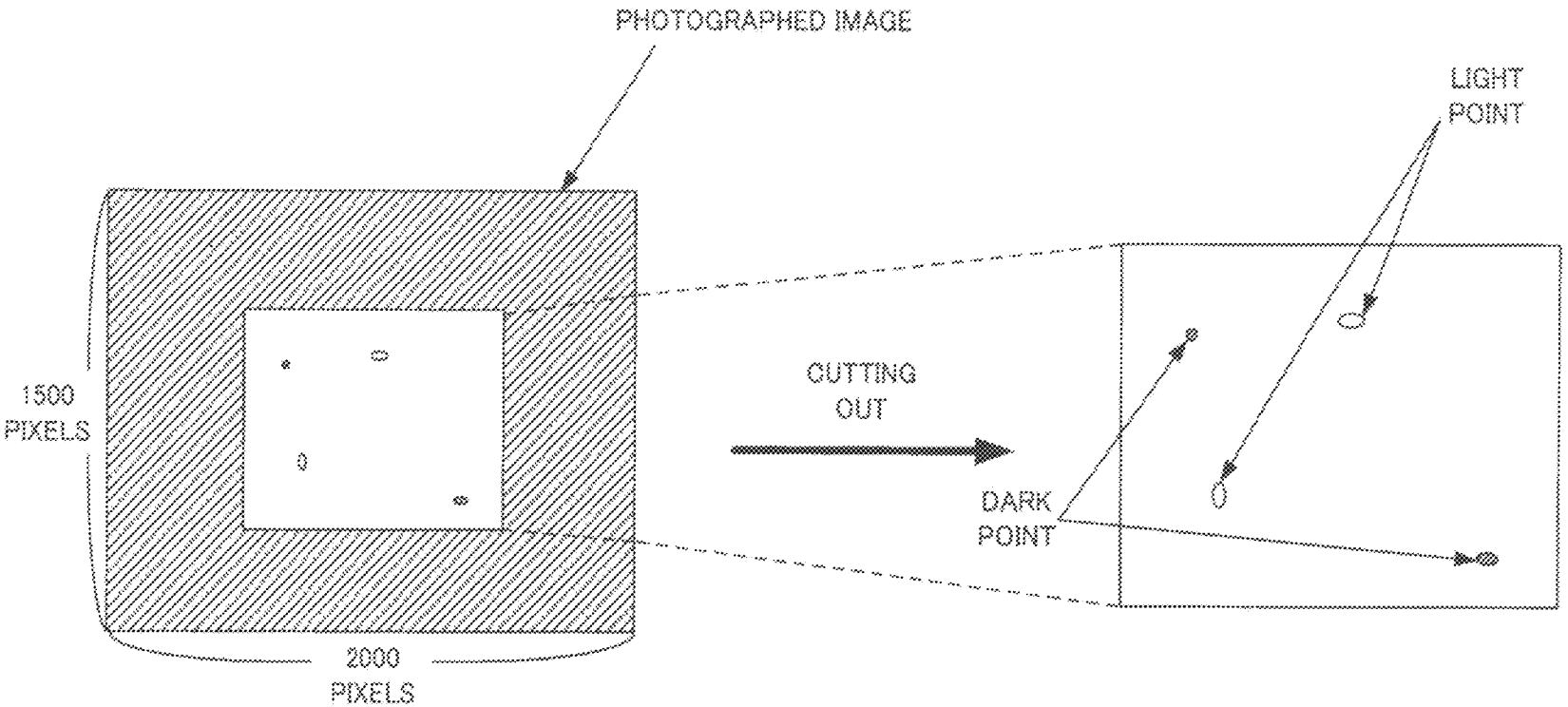
FIG. 6 is a view illustrating the cutting out of a panel portion from a photographed image.

First, the computer 106 detects an edge portion based on a luminance change in the photographed image data, and removes (cuts out) the image data of the light emission portion of the organic EL panel 100. Hereupon, as shown in FIG. 6, the area of the light emission portion is about ¼ of the entire photographed image.

Figure 7B:
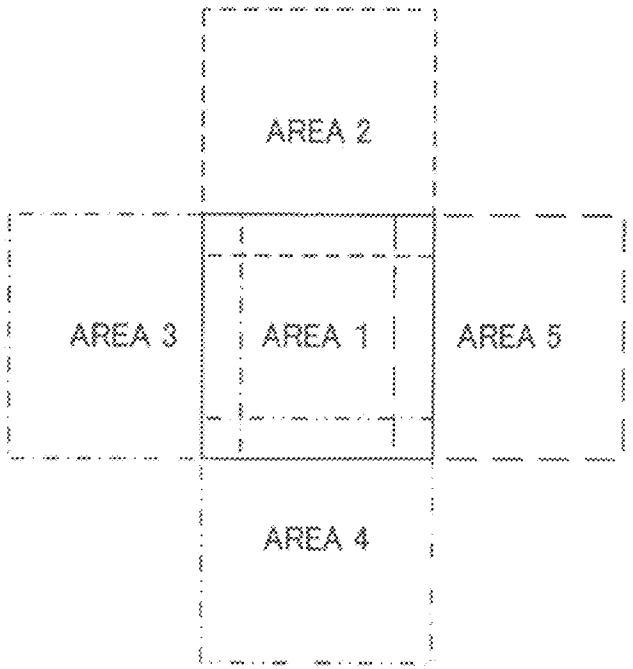
FIGS. 7A and 7B are views illustrating a block for detecting spot-like unevenness.
Figure 7A:
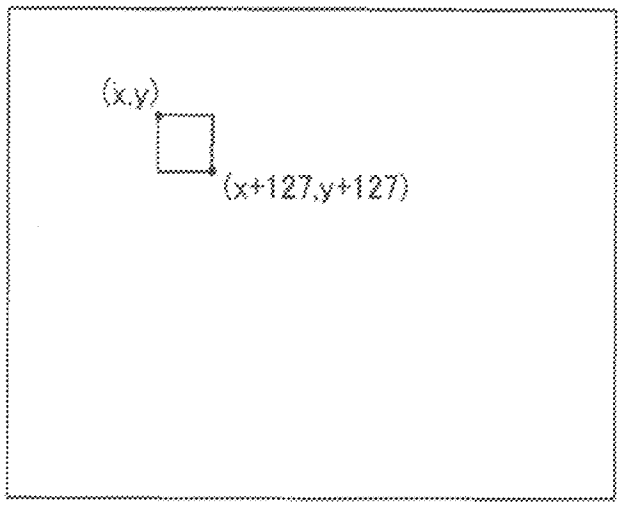

Next, a block of 128×128 pixels is selected from the image of the light emission portion as shown in FIG. 7A, and the existence of spot-like unevenness such as light points or dark points in the cut out block is determined by examining the pixels, in order, beginning from the upper left corner. A simple method of searching for areas including spot-like unevenness within the block is to extract data higher or lower than a certain threshold level of an average data of the whole block from among the data. Furthermore, as the method of changing the threshold value according to the levels of overall unevenness and a measurement error, there is a method of calculating the standard deviation ($\sigma$) of luminance to set an area in which the luminance exceeds $k\times\sigma$ (k is constant) as the area including the unevenness.

Figure 8A:
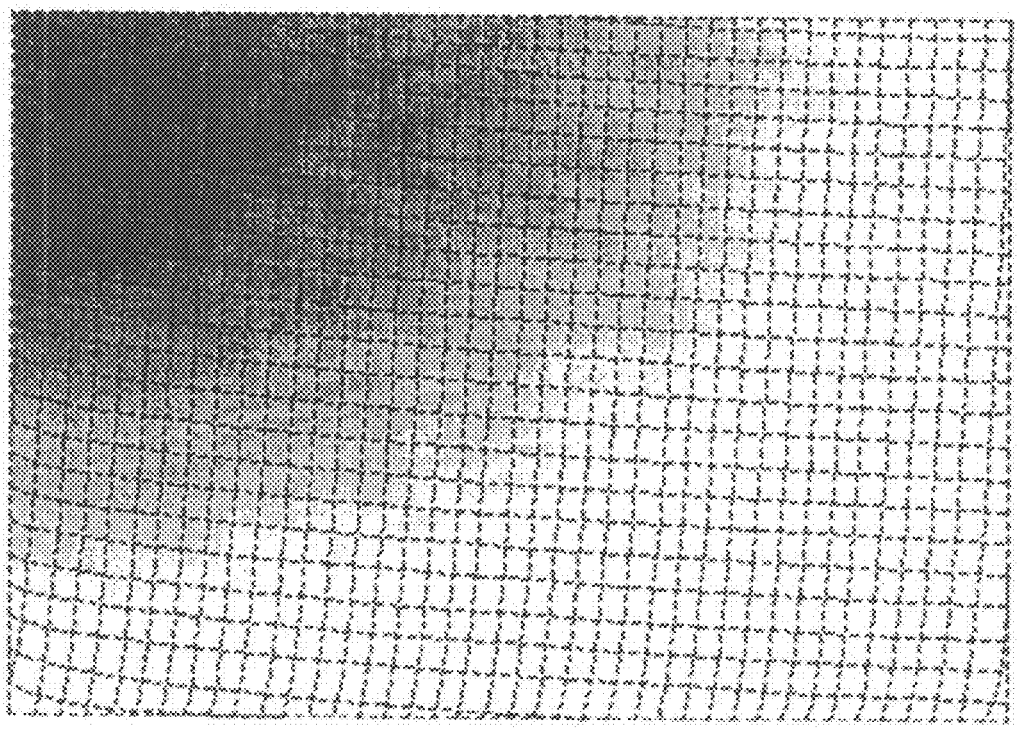
FIG. 8A is a view showing an example of an image including moiré and a gentle luminance change.

Hereupon, because the organic EL panel is composed of the dots of R, G and B and portions which do not emit light also exist between the dots, interference fringes (moiré) are generated on a photographed image owing to a dot period and the sampling period of the pixels of CCD's of the digital camera 104. Moreover, when dispersion is generated in transistor characteristics of the TFT's owing to a problem on manufacture of the TFT's, as shown in FIG. 8A, a gentle and continuous luminance change is generated in the whole display area. In the example of FIG. 8A, the upper left portion is dark and the lower right portion is light, and interference fringes appear in vertical and horizontal directions. Such moiré and a gentle luminance change become a cause of a judgment mistake at the time of searching the areas including spot-like unevenness. Then, the two-dimensional discrete cosine transformation (DCT) of a block of 128×128 pixels is performed as explained in the following in order to remove any moiré and gradual luminance changes before unevenness processing.

Figure 8B:
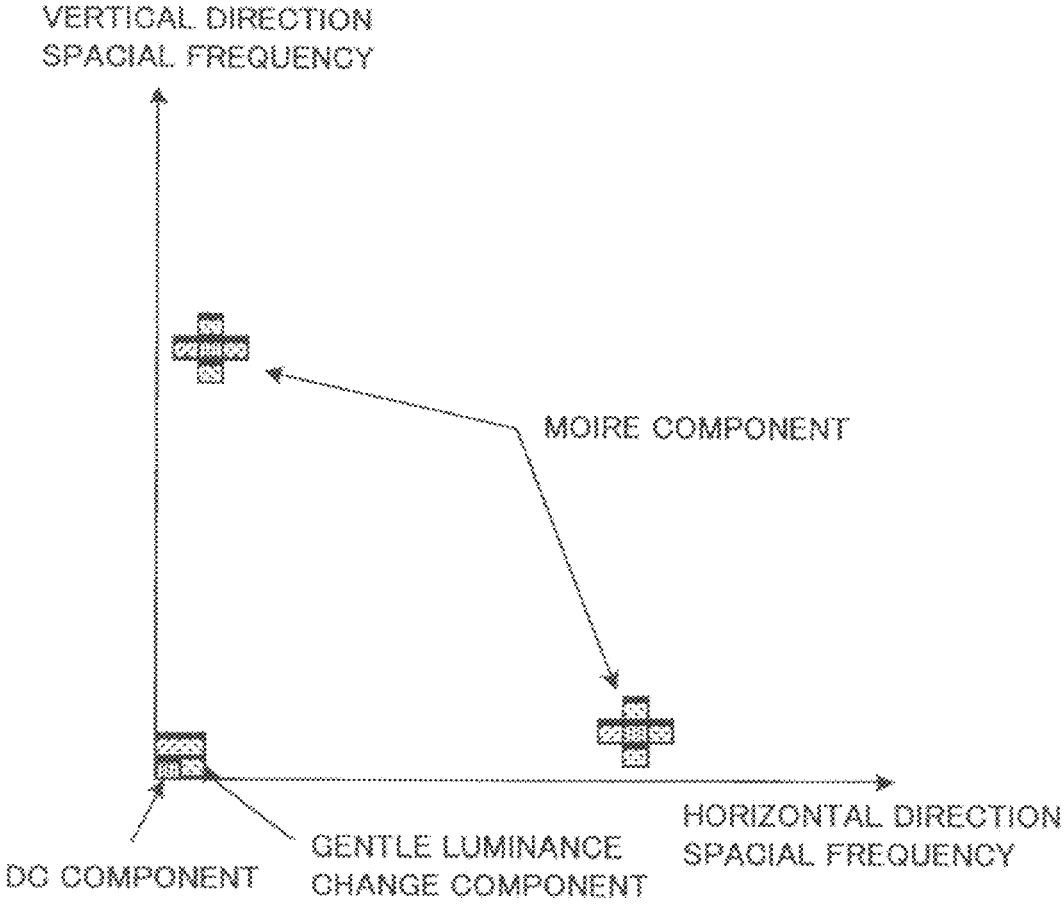
FIG. 8B is a diagram showing moiré after transformation by DCT, and the position of a gentle luminance change on a frequency coordinate.

FIG. 8B shows an example of a result of the execution of the DCT. Normally, a moiré component appears as a certain single frequency component, and the gentle luminance change covering the whole display area appears as a low frequency component. Accordingly, after removing the unnecessary components, the inverse two-dimensional discrete cosine transformation (IDCT) is executed to once again return the block to an area image of 128×128 pixels. Then, the judgment of the spot-like unevenness mentioned above is performed to the image from which the moiré and the gentle luminance change have been removed.

However, near the periphery of a block, the effect of the moiré removal falls, which hinders unevenness detection. Accordingly, as shown in FIG. 7B, it is preferable that the definition of blocks be performed so as to ensure that each block overlaps with the blocks on the left, right, top, and bottom of the block by several pixels. The optimal values for the size of each block and the number of pixels in each overlapping portion are preferably determined according to the number of pixels of an organic EL panel, the number of pixels of a CCD, and the size of the target spot-like unevenness. Furthermore, unevenness in vertical and horizontal lines resulting from manufacturing defects or tolerances can be removed by this processing, therefore the processing is advantageously adapted for searching the spot-like unevenness.

Figure 9A:
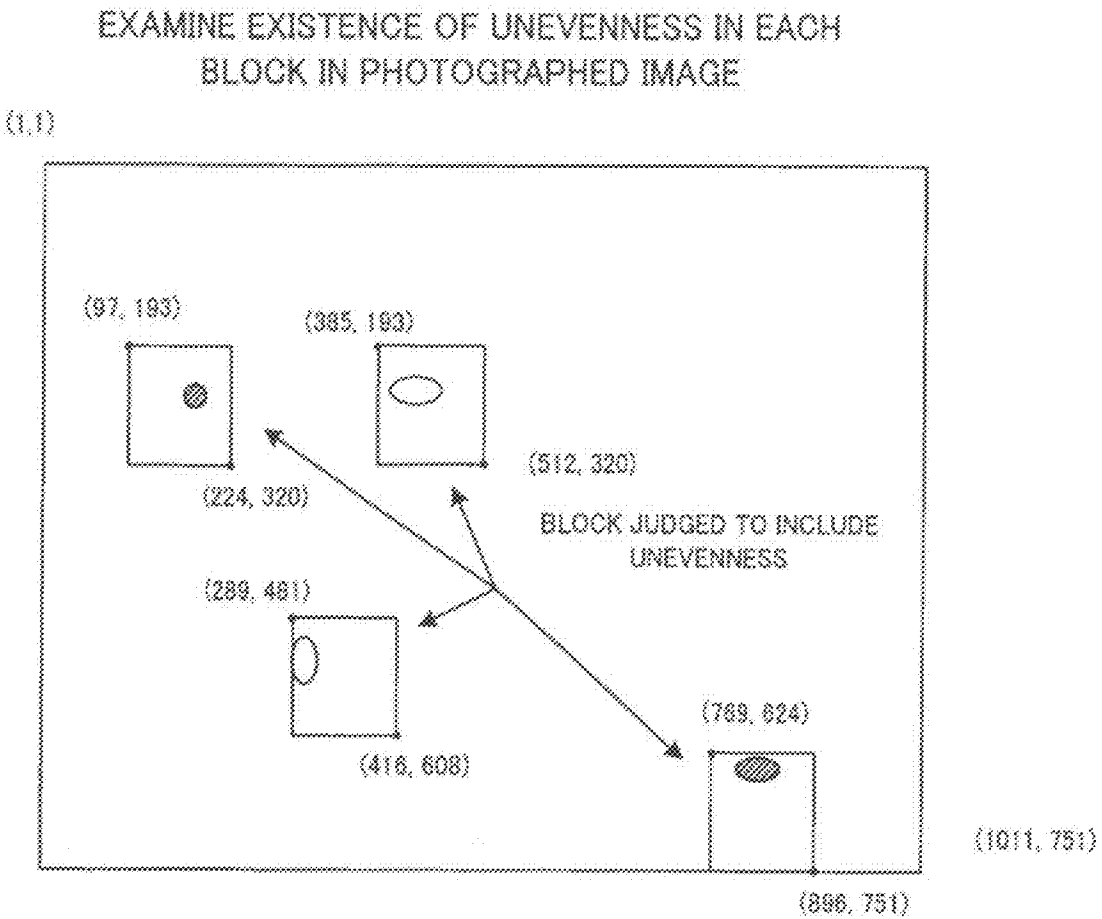
FIG. 9A is a view showing positions of the blocks judged to include unevenness.
Figure 9C:
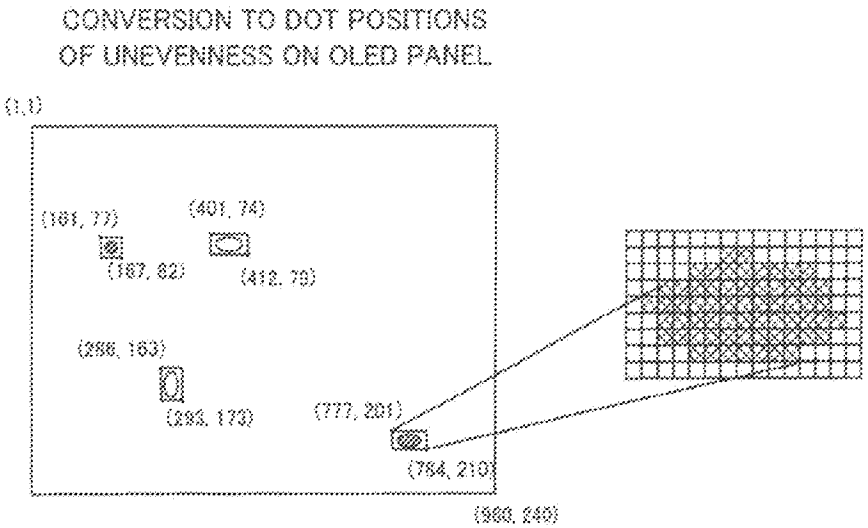
FIG. 9C is a view showing the state in which the positions of unevenness are converted into positions on a panel.
Figure 9B:
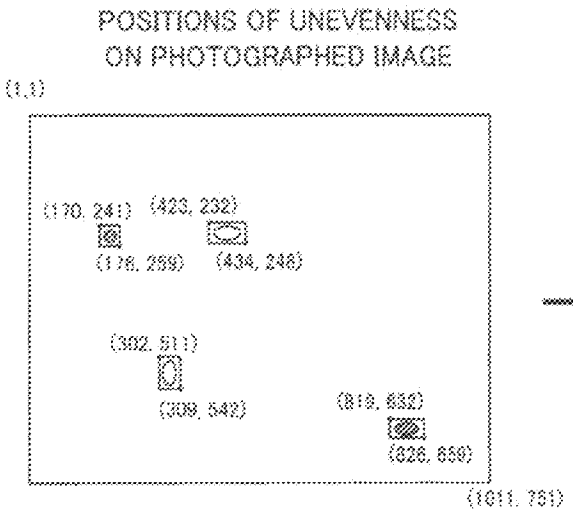
FIG. 9B is a view showing the positions of unevenness on a photographed image.

FIG. 9A shows blocks judged to include unevenness. In this example, spot-like unevenness is detected in four blocks of (97, 193)-(224, 320), (385, 193)-(512, 320), (289, 481)-(416, 608), and (769, 624)-(896, 751). FIG. 9B shows the position of obtained unevenness. Thus, four positions, (170, 241)-(176, 259), (423, 232)-(434, 248), (302, 511)-(309, 542) and (819, 632)-(826, 659), are specified as unevenness positions. Subsequently, as shown in FIG. 9C, the coordinates of each unevenness position are transformed into the positions of the dots on the actual OLED panel, and the approximate positions of unevenness are specified. That is, positions of (161, 77)-(167, 82), (401, 74)-(412, 79), (286, 163)-(293, 173) and (777, 201)-(784, 210) are specified as unevenness positions of the dot positions of the OLED panel.

Figure 10:
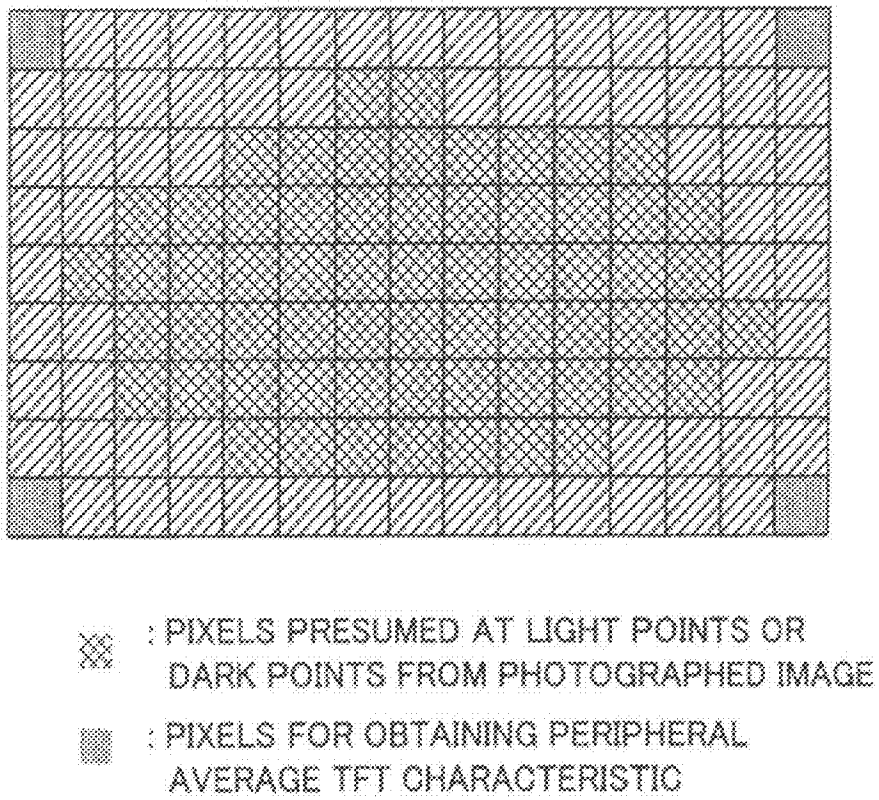
FIG. 10 is a view showing an area of the pixels at which a V-I curve is measured.
Figure 11:
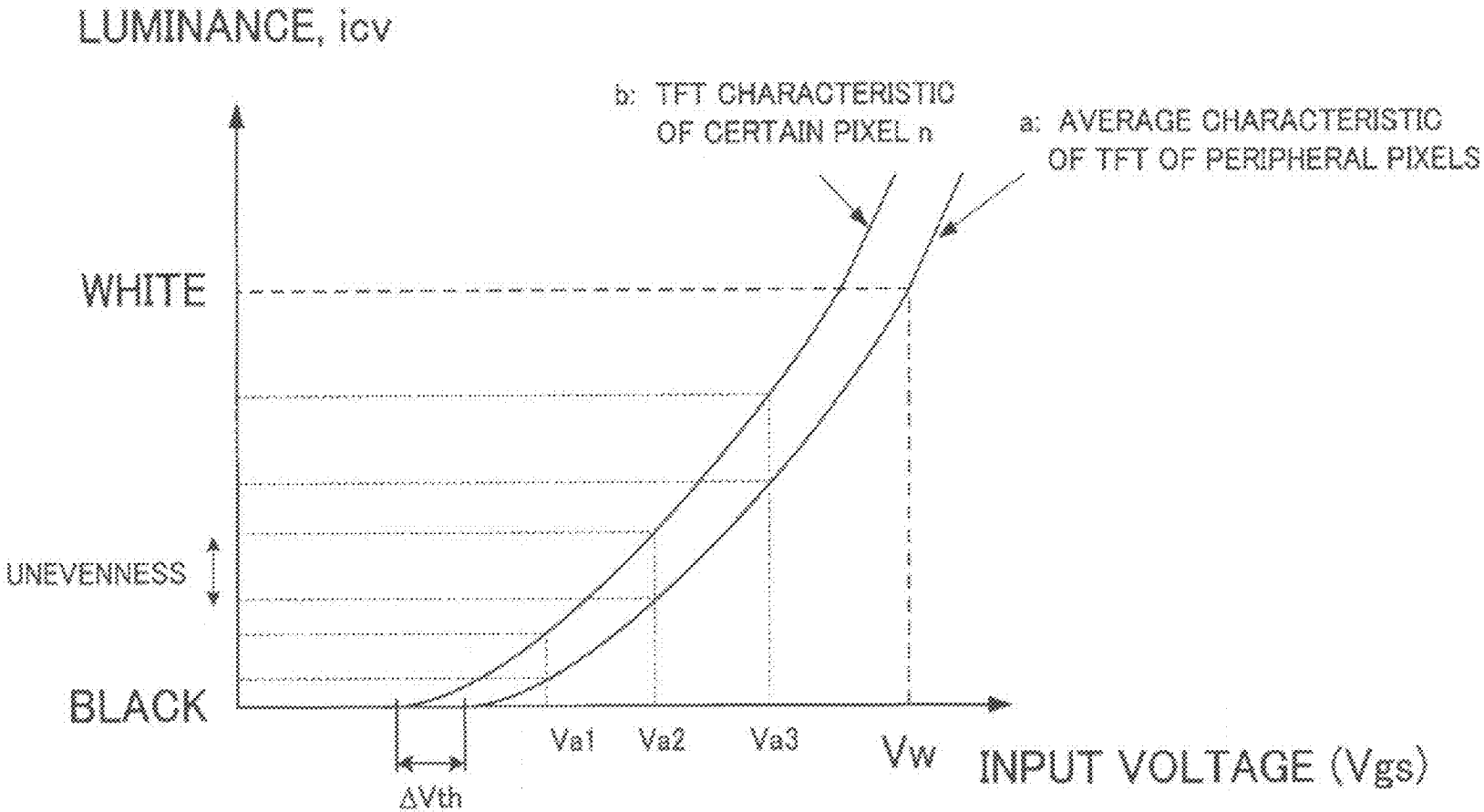
FIG. 11 is a diagram showing an average characteristic of the TFT's at peripheral pixels, and the characteristic of a TFT at a specific pixel n.
Figure 12:
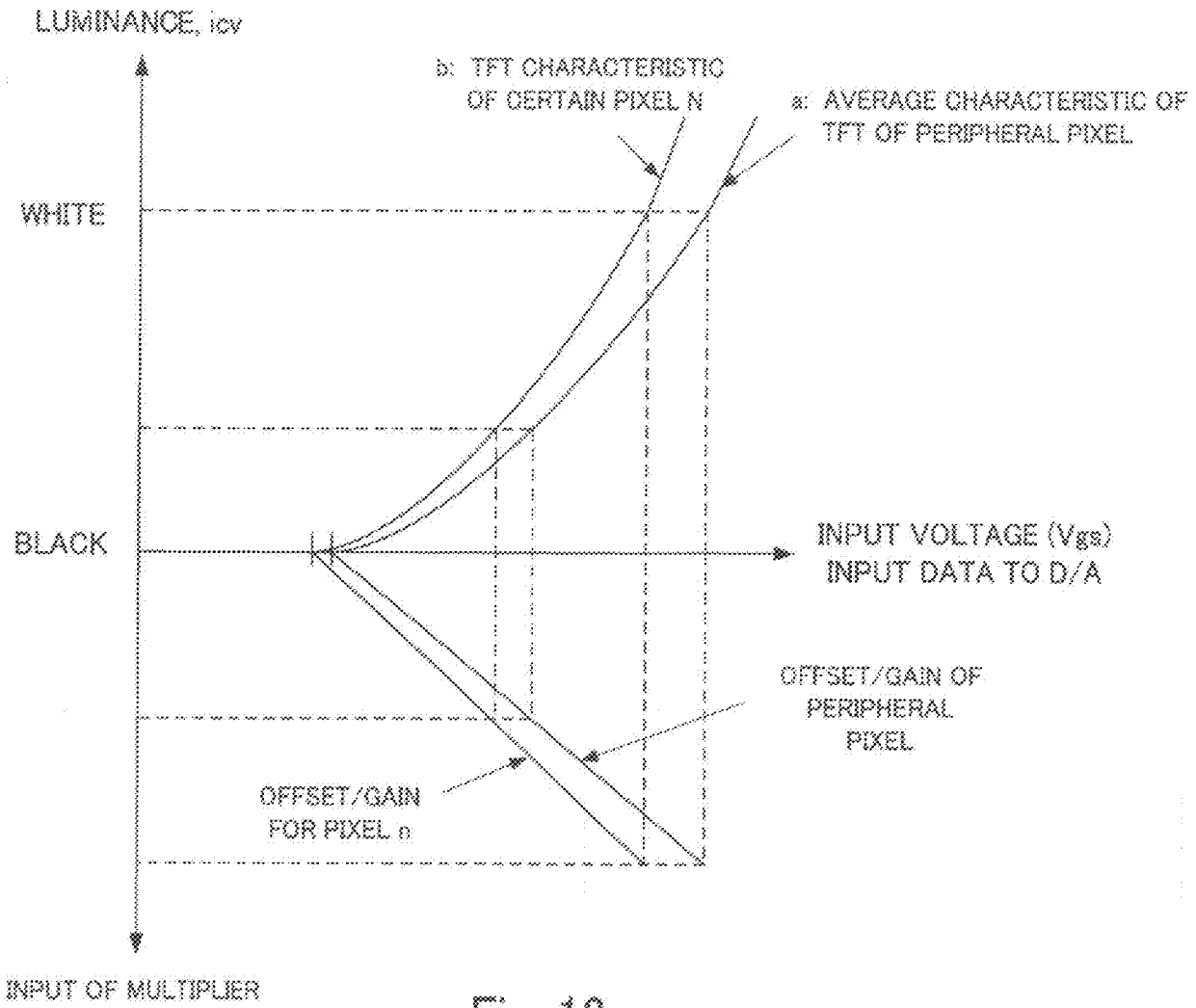
FIG. 12 is a diagram showing an offset/gain of peripheral pixels, and an offset/gain for the pixel n.

Calculation of Correction Values i) As shown in FIG. 10, a rectangle area of 15×9 pixels to the left, the right, the top and the bottom directions from the area judged to include the unevenness is examined. The four pixels at the four corners in the area shown in the figure are simultaneously lit by two or more input voltages (three points Va1, Va2 and Va3 of FIG. 11 in the example), and the CV current at each input voltage is measured. Because the average current (icv) of each pixel is a value obtained by dividing the CV current by 4, the relations of the average currents icv to the input voltages can be plotted. From this result, an average V-I characteristic of TFT's around the area is projected and plotted (a in FIG. 11). It should be noted that the input voltages are the voltages Vgs between the gate and the source of the drive TFT's, and the CV currents are currents icv flowing through the organic EL elements, which correspond to the luminance.

ii) Only one pixel in the area of 15×9 pixels judged to include the unevenness is lit by two or more input voltages (three points Va1, Va2 and Va3 in the example), and the CV current at each input voltage is measured. From the measured results, the V-I characteristic of the TFT of the pixel is projected and plotted (b in FIG. 11). Similarly, the V-I characteristics of the TFT's of all the pixels in the area are projected and plotted.

iii) As shown in FIG. 12, the shift of the threshold voltage Vth (the shift in the lateral direction in the drawing) and the shift of the inclination (gm) of the V-I curve of the pixel n in the area of 15×9 pixels to the peripheral pixels are obtained. The gain (the inclination of the V-I curve) and the offset (the threshold voltage Vth) are obtained on the basis of the characteristics of the peripheral pixels, so that the difference of the CV current or the luminance to those of the characteristics may be minimized. Then, the obtained offsets and gains of the necessary pixels are stored in the nonvolatile memory 36. In this case, it is also preferable to store the obtained offsets and gains as the offset/gain of an average pixel and the correction values of the pixel positions and the offsets/gains of the pixels necessary to be corrected.

Moreover, in the example, it is supposed that the offsets/gains can be plotted as straight lines to the input voltages. Consequently, by storing the values of offsets/gains, the correction values of the input voltages can be calculated. However, the correction values are not necessarily made to be a straight line, and may have the values for transforming the TFT characteristic of the pixel n into an average characteristic of the TFT's of the peripheral pixels as a map.

The method of extracting the area including unevenness using a photographed image can be also used to identify superior panels which include no spot-like unevenness.

The invention has been described in detail with particular reference to certain preferred embodiments thereof, but it will be understood that variations and modifications can be effected within the spirit and scope of the invention.

PARTS LIST

1 P channel TFT
2 TFT
3 organic EL (OLLD) element
10 display panel
20R look-up table
20G look-up table
20B look-up table
22R multiplier
22G multiplier
22B multiplier
24R adder
24G adder
24B adder
26 output unit
28R D/A converter
28G D/A converter
26B D/A converter
30 switch
32 current detector
34 CPU
36 nonvolatile memory
38 memory
40 coordinate generation unit
100 organic EL panel
Parts List cont'd
102 panel drive apparatus
104 digital camera
106 computer
C auxiliary capacity

The invention claimed is:

1. A method of correcting for pixels in an organic EL display device needing correction, in a matrix, the method comprising:

photographing an image of a display area with an imaging apparatus to specify an area in which display unevenness exists, including dividing the photographed image of the entire display area into blocks of equal size and comparing data for each pixel in each respective block and an average value of the data in all the pixels in the block, each block comprising a plurality of pixels, each block partially overlapping another block;

causing the organic EL elements of the display pixels in the specified area to emit light selectively to detect a drive current of the light emission;

calculating positions of pixels needing correction and correction data based on the detected drive current; and storing the obtained positions of the pixels needing correction and the correction data in a memory.

* * * * *